US010975502B2

(12) United States Patent
Sencopur

(10) Patent No.: US 10,975,502 B2
(45) Date of Patent: Apr. 13, 2021

(54) KNITTING YARN AND METHOD OF FORMING KNITTED PRODUCT

(71) Applicant: Yunteks Tekstil Sanayi Ve Ticaret Limited Sirketi, Isparta (TR)

(72) Inventor: Mehmet Abdullah Sencopur, Isparta (TR)

(73) Assignee: YUNTEKS TEKSTIL SANAYI VE TICARET LIMITED SIRKETI, Isparta (TR)

( * ) Notice: Subject to any disclaimer, the term of this patent is extended or adjusted under 35 U.S.C. 154(b) by 18 days.

(21) Appl. No.: 16/515,059

(22) Filed: Jul. 18, 2019

(65) Prior Publication Data

US 2020/0347523 A1 Nov. 5, 2020

(30) Foreign Application Priority Data

Apr. 30, 2019 (EP) ..... 19172069

(51) Int. Cl.

| | |
|---|---|
| ***D02G 3/34*** | (2006.01) |
| ***D04B 5/00*** | (2006.01) |
| *D02G 3/04* | (2006.01) |
| *D04B 3/00* | (2006.01) |
| *D04B 39/00* | (2006.01) |

(52) U.S. Cl.

CPC ..... *D02G 3/34* (2013.01); *D04B 5/00* (2013.01); *D02G 3/04* (2013.01); *D04B 3/00* (2013.01); *D04B 39/00* (2013.01)

(58) Field of Classification Search

CPC ... D02G 3/34; D02G 3/04; D04B 5/00; D04B 3/00; D04B 39/00

USPC ..... 66/4

See application file for complete search history.

(56) References Cited

U.S. PATENT DOCUMENTS 1,386,444 A * 8/1921 Stibbe ..... D04B 1/00 66/190
1,388,781 A * 8/1921 Stibbe ..... D04B 9/06 66/9 R
1,691,527 A * 11/1928 Sakurai ..... D04B 17/00 66/1 A (Continued)

FOREIGN PATENT DOCUMENTS

WO 2018182545 A1 10/2018

OTHER PUBLICATIONS

Free Loop Yarn Finger Knitting Blanket Pattern Tutorial for Beginners (Year: 2018).*

*Primary Examiner* — Danny Worrell
*Assistant Examiner* — Dakota Marin
(74) *Attorney, Agent, or Firm* — Bayramoglu Law Offices LLC

(57) ABSTRACT

A knitting yarn for manually forming a knitted product without tools includes a thread having a length dimension extending along an axis (A); a plurality of loops affixed to or formed with the thread by extending outwardly of the thread; and each of the plurality of loops defining an interior space adapted to receive another loop of the plurality of loops. The plurality of loops includes a first loop set mainly extending outwardly along +y axis and a second loop set extending along −y axis; and, the first loop set is essentially symmetrical to the second loop set around the symmetry axis (A). A method of manually forming a knitted product by using the knitting yarn; and the knitted product obtained thereof.

20 Claims, 7 Drawing Sheets

(56) References Cited

U.S. PATENT DOCUMENTS

| | | | | | |
|---|---|---|---|---|---|
| 1,705,860 | A * | 3/1929 | Hagihara | D04B 17/00 | 66/4 |
| 1,722,391 | A * | 7/1929 | Pfrommer | D04B 1/12 | 66/196 |
| 1,738,486 | A * | 12/1929 | Wesseler | D04B 9/44 | 66/1 A |
| 2,609,676 | A * | 9/1952 | Woroneski | D04G 3/02 | 66/4 |
| 3,234,759 | A * | 2/1966 | Larrasoain | D04B 9/54 | 66/1 A |
| 3,458,988 | A | 8/1969 | Marshall | | |
| 3,535,891 | A * | 10/1970 | Corey | D04B 37/02 | 66/1 A |
| 3,577,748 | A * | 5/1971 | Nortland | D04B 39/00 | 66/4 |
| 4,362,032 | A * | 12/1982 | Palange | D04B 39/00 | 66/117 |
| 9,027,366 | B2 * | 5/2015 | Raynor | D04B 31/00 | 66/1 A |
| 9,334,589 | B2 * | 5/2016 | Eddy | A44C 27/002 | |
| 2009/0019614 | A1 * | 1/2009 | Hagihara | A41D 19/01529 | 2/16 |

* cited by examiner

KNITTING YARN AND METHOD OF FORMING KNITTED PRODUCT

CROSS REFERENCE TO THE RELATED APPLICATIONS

This application is based upon and claims priority to European Patent Application No. EP 19172069.7, filed on Apr. 30, 2019, the entire contents of which are incorporated herein by reference.

TECHNICAL FIELD

The present invention relates to a knitting yarn, and particularly it concerns a novel knitting yarn having a thread with a plurality of loops affixed to or formed with the thread. Furthermore, the present invention relates to a method for forming a knitted product by using the knitting yarn according to the present invention.

BACKGROUND

Fancy yarns particularly having a yarn effect are designed mainly for their aesthetic appearance rather than performance. These yarns, also called as wrapped yarns, can mostly be created by using the traditional ring spinning system but with additional feeding and control devices, and more recently with the hollow spindle system. These fancy yarns always contain at least three basic component strands, namely a core, a binder and an effect strand. The binder strand is used to fix the effect strand on to the core strand in an irregular fashion.

U.S. Pat. No. 3,458,988 A discloses a wrapped yarn comprising at least one generally straight tensile-bearing core strand, a first strand twisted in an irregular looped fashion around the core strand, and a second strand serving to hold the first strand in place. The yarn is only suitable to be knitted with the known knitting methods, i.e. by using tools such as knitting needles or crochet hooks, and by forming knitting loops from the disclosed straight yarn with the help of the knitting tools. Furthermore, the disclosed first strand functions as an effect strand on a knitted product when the wrapped yarn is knitted with the known knitting methods.

As described above, knitting apparatuses such as crochet hooks or knitting needles are used when knitting is carried out with the yarns present in the state of the art. The knitting procedure is quite difficult for a person without skills to properly knit products using normal conventional threads, since it requires one to learn the specifics of knitting, including the use of such tools. Even if such a person would have experience and skill in knitting, it still takes a significant amount of time for such a person to knit large items. As such, a need has developed to provide a knitting yarn and method of forming a knitted product which allows a person to quickly learn procedures for forming the knitted product and allows the person to carry out the knitting manually without the use of any tools, such as crochet hooks or knitting needles.

On the other hand, WO2018182545 (A1) discloses a thread with rings that can be used to obtain large surfaced knitted items without using knitting apparatus such as crochet hooks, knitting needles etc. and a method with which knitted items are obtained by using the thread with the rings. However, all of the disclosed rings of the mentioned thread extend outwardly of only one side of the thread as clearly shown in figure pages of referenced document. Therefore, it is not possible to obtain a knitted product having two different patterns and/or colors on its back and front knitted surfaces with the disclosed thread of this document. Thereby, the knitted surfaces obtained with the thread of this document do not have a first and a second surface which essentially present different properties from each other i.e., different patterns and colors.

SUMMARY

Primary object of the present invention is to eliminate the above-mentioned shortcomings explained in the present state of the art.

Another object of the present invention is to provide a knitting yarn and a method of forming a knitted product which does not require use of any knitting tools.

Another object of the present invention is to provide a knitting yarn and method of forming a knitted product which allows for knitting with no special training or experience and that can be used by persons of all ages.

Another object of the present invention is to provide a knitting yarn and method of forming a knitted product which can facilitate the development of children in terms of dexterity and mathematical knowledge.

Another object of the present invention is to provide a knitting yarn and method of forming a knitted product which can be sized to the desired dimensions.

Another object of the present invention is to provide a knitting yarn and method of forming a knitted product which eliminates any stiffness, rigidity, or hardness in the knitted product.

Another object of the present invention is to provide a knitting yarn and method of forming a knitted product which is easy to use, easy to manufacture and relatively inexpensive.

Another object of the present invention is to provide a knitting yarn and method for forming a knitted product having patterns thereon.

A further object of the present invention is to provide a knitting method for forming a knitted product having surfaces with different properties compared to each other.

The present invention proposes a knitting yarn for manually forming a knitted product without tools comprising a thread having a length dimension extending along an axis (A); a plurality of loops affixed to or formed with the thread by extending outwardly of the thread; and each of the plurality of loops defining an interior space adapted to receive another loop of the plurality of loops. The plurality of loops includes a first loop set mainly extending outwardly along +y axis and a second loop set extending along −y axis; and, the first loop set is essentially symmetrical to the second loop set around the symmetry axis (A).

According to an embodiment of the present invention, the thread and/or loops are independently made of one or more component yarns optionally comprising different textile materials. Furthermore, physical and/or structural properties of the component yarns of the first loop set and the second loop set may be different.

According to an embodiment of the present invention, each of the plurality of loops includes a first end affixed to or formed with the thread and a second end affixed to or formed with the thread. The first end of a loop is optionally in spaced relation to the second end of the same loop. In other words, in each loop, the first end and the second end are spaced apart from each other. Furthermore, the interior space of each of the plurality of loops has a height dimension (h) that is preferably greater than a width distance (w)

between the first end and second end of the loop. Also, the second end of a primary loop is optionally in spaced relation to a first end of a second loop adjacent to the primary loop within the same loop set.

The present invention further proposes a method for manually forming a knitted product by using a knitting yarn according to the present invention. The method comprises the steps of: (i) arranging the knitting yarn into a plurality of rows each of which includes a predetermined number of loops; (ii) threading one or more loops of a first loop set of an arranged secondary row through an interior space of each corresponding loop of a first loop set of an arranged primary row; (iii) repeating the previous steps independently, until at least a piece of the knitted product is formed. Preferably, the method step (iii) further comprises the steps of (a) threading each one of the loops of the first loop set and/or the second loop set of an arranged tertiary row through the interior spaces of each one of the respective corresponding loops of a threaded row, which was obtained by treading the loops of the secondary row through the corresponding loops of the primary row; (b) threading each one of the loops of the first loop set and/or the second loop set of an arranged quaternary row through the interior spaces of each one of the respective corresponding loops of another threaded row, which was obtained b threading the loops of the tertiary row through the corresponding loops of the threaded row; and (c) applying threading steps of "a" or "b" to further arranged row(s) and threaded row(s) till a final row is obtained.

The method of the present may further comprise (iv) threading one or more loops of a second loop set of the arranged secondary row through an interior space of each corresponding loop of a second loop set of the arranged primary row, which is carried out after any one of the steps (ii) or (iii).

According to a preferred embodiment of the present invention, for creating a pattern on the surfaces of the knitted product, the method comprises: threading at least one loop of a first loop set of a determined row through an interior space of each corresponding loop of a second loop set of a consecutive row, which is adjacent to the determined row; and threading at least one loop of a second loop set of the determined row through an interior space of each corresponding loop of the first loop set of the consecutive row, wherein the loops of the first loops set are symmetric to the loops of the second loop set around the axis.

Optionally, each one of the rows arranged in step (i) of the disclosed method comprises same or different number of loops.

According to a preferred embodiment, the method of the present invention further comprises the following step carried out after step (iii) or (c) disclosed above: (v) binding off the loops of the final row together. Furthermore, the binding step (v) comprises the intermediary steps of; (vi) inserting a second loop of the first loop set of the final row through the interior space of an adjacent first loop of the first loop set of the final row; (vii) inserting a third loop of the first loop set of the final row through the interior space of the adjacent loop obtained in above step (vi) of the first loop set of the final row; (viii) inserting a second loop of the second loop set of the final row through the interior space of an adjacent first loop of the second loop set of the final row; (ix) inserting a third loop of the second loop set of the final row through the interior space of the adjacent loop obtained in above step (viii) of second loop set of the final row; and (x) repeating inserting steps (vii) and (ix) to further loops and obtained loops until all loops of the final row are bound off.

The present invention further proposes a knitted product obtained by knitting a knitting yarn according to the method steps of the present invention.

BRIEF DESCRIPTION OF THE DRAWINGS

The figures whose brief explanations are herewith provided are solely intended for providing a better understanding of the present invention and are as such not intended to define the scope of protection or the context in which said scope is interpreted in the absence of the present description.

LIST OF REFERENCE SIGNS USED IN THE TEXT AND DRAWINGS

Figure 1:
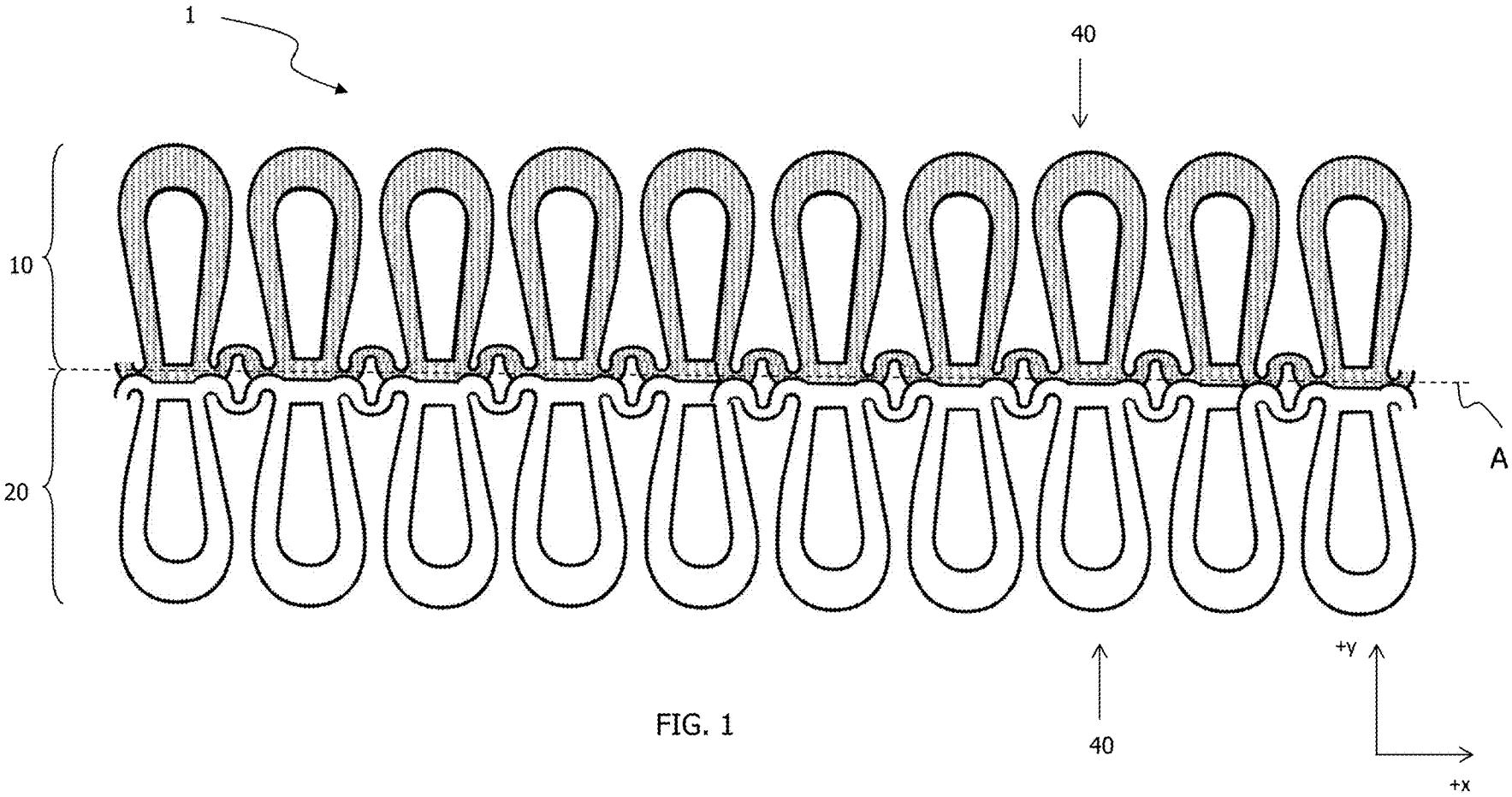
FIG. 1 demonstrates a general front view of the knitting yarn according to the present invention.

1 knitting yarn
10 first loop set

11 loop of a first loop set
20 second loop set
21 loop of a second loop set
30 thread
31 primary row
32 secondary row
33 tertiary row
34 quaternary row
39 final row
40 loop
41 first end
42 second end
43 interior space
100 knitted product
101 first surface
102 second surface
A symmetry axis
d distance between a second end of a loop and a first end of another loop adjacent thereof
h height distance
w width distance

DETAILED DESCRIPTION OF THE EMBODIMENTS

Figure 17:
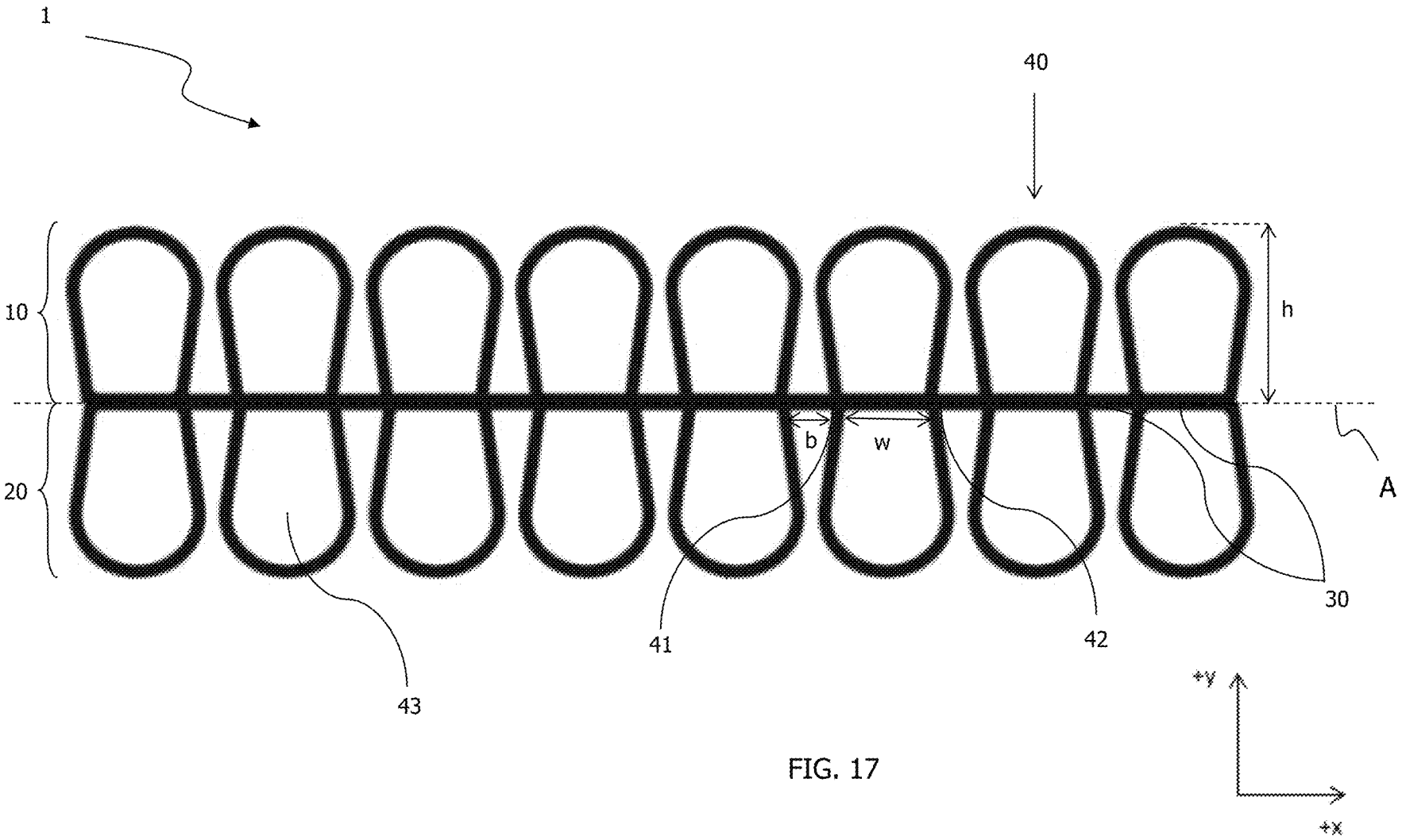
FIG. 17 exemplifies a row of the knitting yarn according to the present invention.

The present invention provides a knitting yarn (1) for manually forming a knitted product (100) without using any knitting tool such as crochet hooks, knitting needles or etc. As shown in FIG. 1 and FIG. 17, the knitting yarn (1) comprises a thread (30) having a length dimension extending along an axis (A) and a plurality of loops (40) affixed to or formed with the thread (30) by extending outwardly of the thread (30), and each one of the plurality of loops (40) defines an interior space (43) adapted to receive another loop (40) of the plurality of loops (40). Furthermore, the plurality of loops (40) includes a first loop set (10) mainly extending outwardly along +y axis and a second loop set (20) extending along −y axis where the first loop set (10) is essentially symmetrical to the second loop set (20) around the symmetry axis (A). Thus, a knitted product (100) having a first surface (101) and a second surface (102) provided by using different parts, i.e. loops, of a yarn is obtained. Accordingly, the obtained knitted product (100) may comprise surfaces essentially having different properties than each other i.e., different patterns and colors. Referring to the figures outlined above, the first loop set (10) and second loop set (20) may extend in a direction mainly perpendicular to the axis (A).

The thread (30) and/or loops (40) of the knitting yarn (1) according to an embodiment of the present invention are independently made of one or more component yarns optionally comprising different textile materials. In case of a multi-component yarn structure is provided in such a knitting yarn (1), the component yarns may be selected as to be identical or different than each other. Since the component yarns of the thread (30) and/or the loops (40) can optionally be selected from different types of component yarns and can be interlocked as to obtain a multi-component yarn, the multi-component knitting yarns (1) according to the present invention having different properties can be provided according to the preferences of the user.

According to a preferred embodiment of the present invention, physical and/or structural properties of the component yarns of the first loop set (10) and the second loop set (20) are different when compared to each other. As summarized in FIG. 1 and FIG. 2, the thread (30) where the first loop set (10) and the second loop set (20) affixed to or formed with the same can be selected as a multi-component thread made of the component yarns of both the first loop set (10) and the second loop set (20). Thereby, knitting yarn (1) having a uniform component yarn distribution with regards to physical and/or structural properties of the component yarns can be provided.

Referring to FIG. 17, each one of the plurality of loops (40) includes a first end (41) and a second end (42) affixed to or formed with the thread (30). According to one embodiment of the present invention, the first end (41) and the second end (42) of each of the loops (40) are positioned as to be in the same location on the thread (30). On the other hand, as shown in FIG. 17, the first end (41) of a loop (40) may be in spaced relation to the second end (42) thereof as to establish a width distance (w) between the ends of a loop (40). In other words, in each loop, the first end and the second end are spaced apart from each other. The locations of the first end (41) and the second end (42) of each loop (40) relative to each other affect the surface appearance of the knitted product (100) obtained by applying the knitting method of the present invention on the disclosed knitting yarn (1).

Furthermore, the interior space (43) of each of the plurality of loops (40) preferably has a height dimension (h) that is greater than the width distance (w) between the first end (41) and the second end (42) of the loops (40). The disclosed height distance (h) is effective in adjusting the yarn density of the knitted product (100) obtained by knitting the knitting yarn (1) of the present invention according to the method described below. Applications in which the knitting yarn (1) having a relatively greater height distance (h) is used, the yarn density in the direction of +y or −y is low, whereas applications in which the knitting yarn (1) having a relatively small height distance (h) is used, the yarn density is high.

According to another embodiment of the present invention, second end (42) of a primary loop (40) and first end (41) of a second loop (11) adjacent to the primary loop (40) on the same row are positioned as to be in the same location on the thread (30). On the other hand, as shown in FIG. 17, the second end (42) of the primary loop (40) may be in spaced relation to the first end (41) of the second loop (11) as to establish a distance (d) between the ends of the adjacent loops (40). The locations of the first end (41) and the second end (42) of two adjacent loops (40) on the same row of the thread (30) effects the yarn density of the knitted product (100) obtained by knitting the knitting yarn (1) of the present invention according to the method described below. Applications in which the knitting yarn (1) having a relatively small distance (d) is used, the yarn density of the knitted product (100) in the direction of +x or −x is high, and conversely, applications in which the knitting yarn (1) having a relatively greater distance (d) is used, the yarn density of the knitted product (100) is low.

As disclosed above, each one of the plurality of loops (40) defines an interior space (43) adapted to receive another loop (40) of the plurality of loops (40). Preferably, each one of the plurality of loops (40) has the same configuration with the others based on its dimension as illustrated in the given figure pages. Accordingly, a knitted product (100) having a planar first surface (101) and a second surface (102) is provided. As will be appreciated by a person skilled in the art, in case the loops (40) are obtained as to have different dimensions, the surfaces of the knitted product (100) will include surface irregularities. In order to meet the requirements of the user, knitting yarns (1) containing loops (40) with different dimensions can also be provided. Furthermore, the disclosed first loop set (10) is essentially symmetrical to the second loop set (20) around the symmetry axis (A). This configuration allows the formation of a knitted product (100) having a regular surface structure and also creating different patterns on the surfaces of the knitted product (100).

Figure 2:
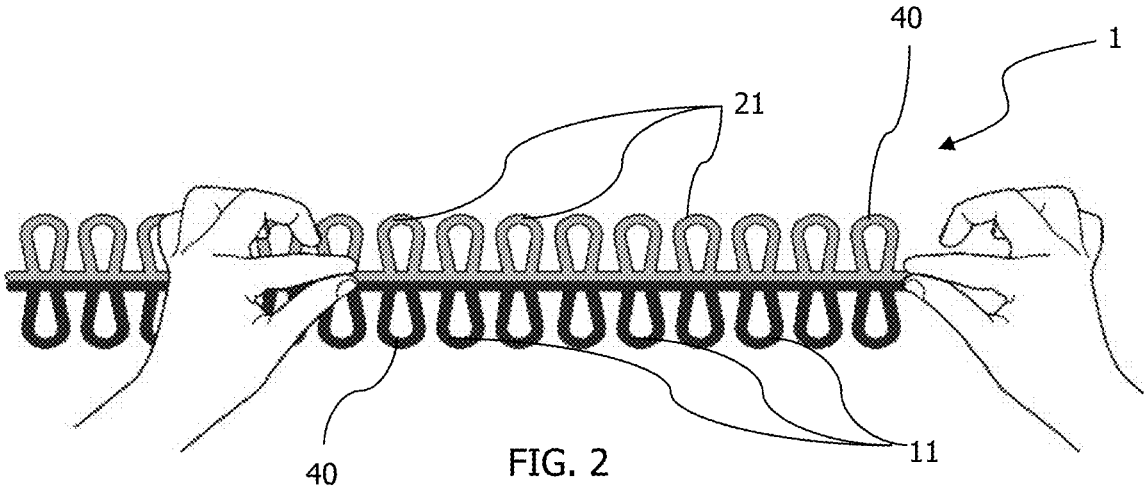
FIG. 2 demonstrates step (i) of arranging the knitting yarn into rows in the method of forming a knitted product.
Figure 3:
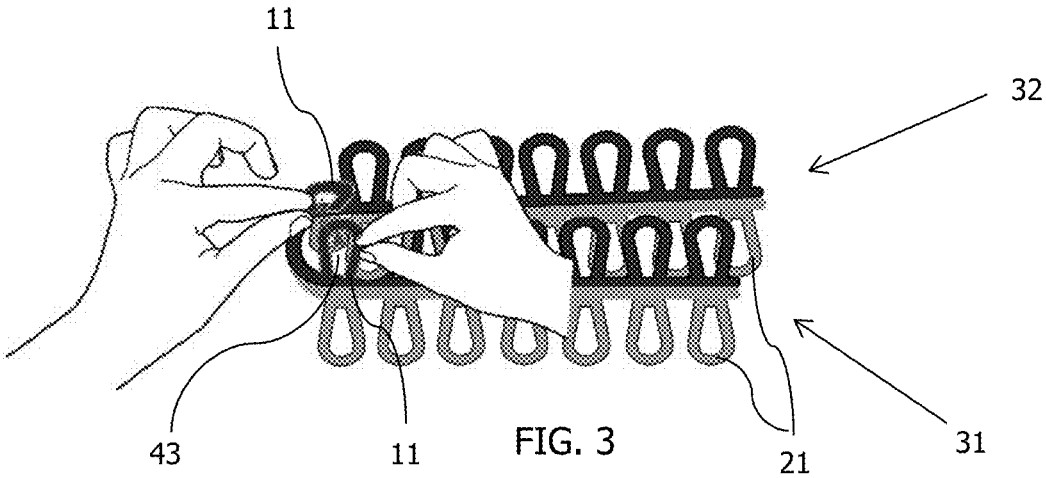
FIG. 3 demonstrates step (ii) of threading a loop of a secondary row through an interior space of a loop of a primary row in the method of forming a knitted product.
Figure 4:
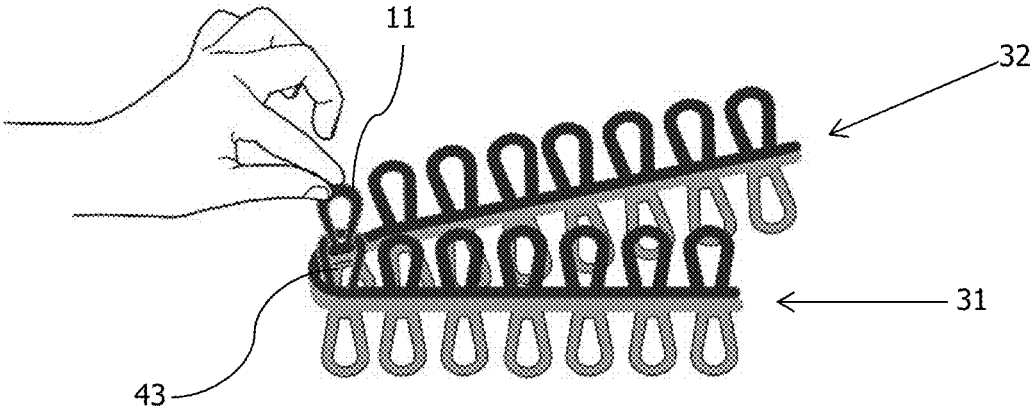
FIG. 4 demonstrates the view of loops after a loop of a secondary row is threaded through an interior space of a loop of a primary row.
Figure 7:
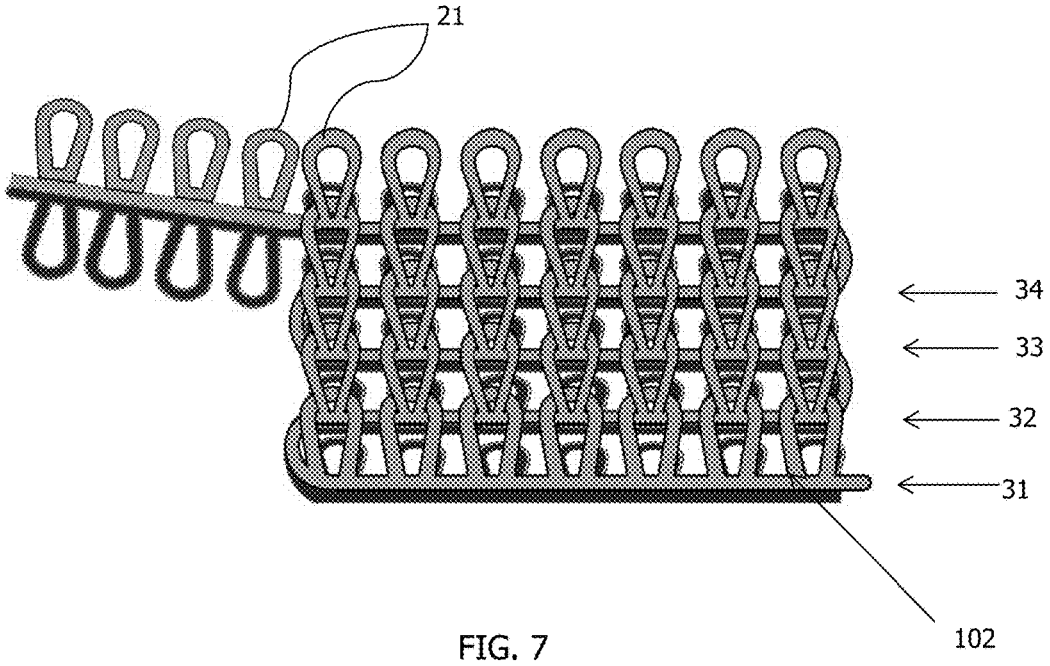
FIG. 7 demonstrates the view of second surface of a knitted product formed by the method according to the present invention.
Figure 8:
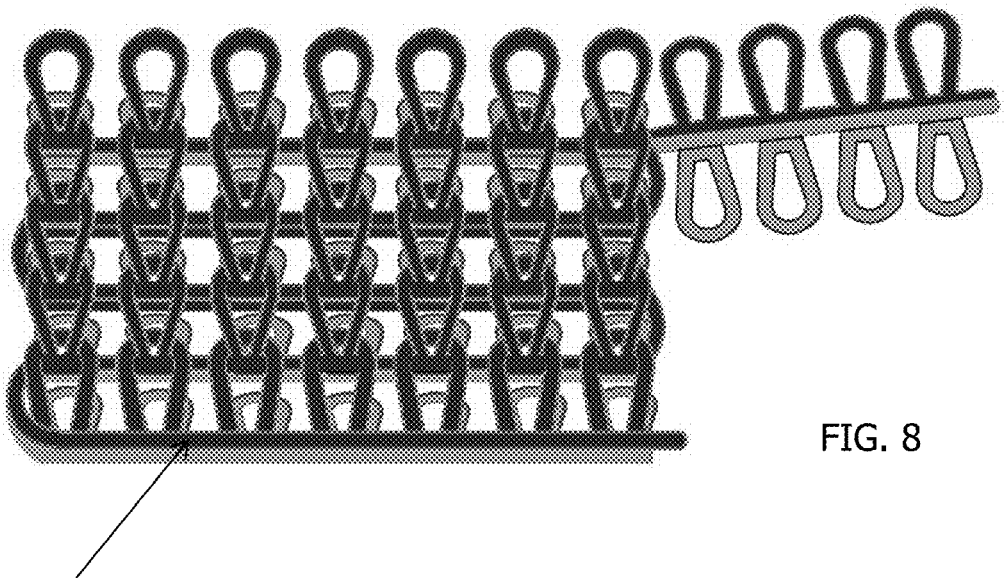
FIG. 8 demonstrates the view of first surface of a knitted product formed by the method according to the present invention.

The present invention further proposes a method for manually forming a knitted product (100) by using a knitting yarn (1) according to the present invention. The method comprises:

(i) arranging the knitting yarn (1) into a plurality of rows each of which includes a predetermined number of loops (40), as shown in FIG. 2;

(ii) threading one or more loops of a first loop set (11) of an arranged secondary row (32) through an interior space (43) of each corresponding loop of a first loop set (11) of an arranged primary row (31), as shown in FIG. 3;

(iii) repeating the previous steps independently, until at least a piece of the knitted product (100) is formed, as shown in FIG. 7 to FIG. 8.

Figure 5:
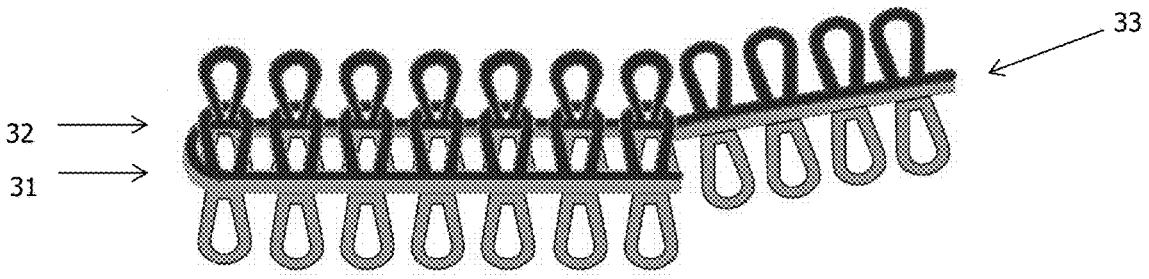
FIG. 5 demonstrates the view of loops after all loops of the secondary row is threaded through an interior space of loops of the primary row.

Preferably, the above disclosed knitting method also comprises threading each one of the loops of the first loop set (11) of the secondary row (32) through the interior spaces (43) of each one of the respective corresponding loops of the first loop set (11) of the primary row (31), carried out after the step (ii). FIG. 5 shows the illustration of the knitted thread (30) and the loops (40) after this method step is applied.

According to an embodiment of the present invention, the method comprises steps of threading only the loops of first loop set (11) and not the loops of the second loop set (21), or, as a second other option, threading only the loops of the second loop set (21) and not the loops of the first loop set (11). By knitting the knitting yarn (1) of the present invention accordingly, a knitted product (100) is obtained wherein respectively the first surface (101) or the second surface (102) of the knitted product (100) is knitted and the other surface thereof, i.e. respectively the second surface (102) or the first surface (101), is not knitted and the loops (40) of the non-knitted surface are free ended. Thus a knitted product (100) having surfaces with different physical appearance and also surface properties may be obtained, according to demand of the knitter/user. The free ended loops (40), i.e. not knitted loops, provide a soft, fluffy appearance to the knitted product (100).

According to a preferred embodiment of the present invention, the method further comprises the following step carried out after any one of the steps (ii) or (iii):

(iv) threading one or more loops of a second loop set (21) of the arranged secondary row (32) through an interior space (43) of each corresponding loop of a second loop set (21) of the arranged primary row (31).

Figure 6:
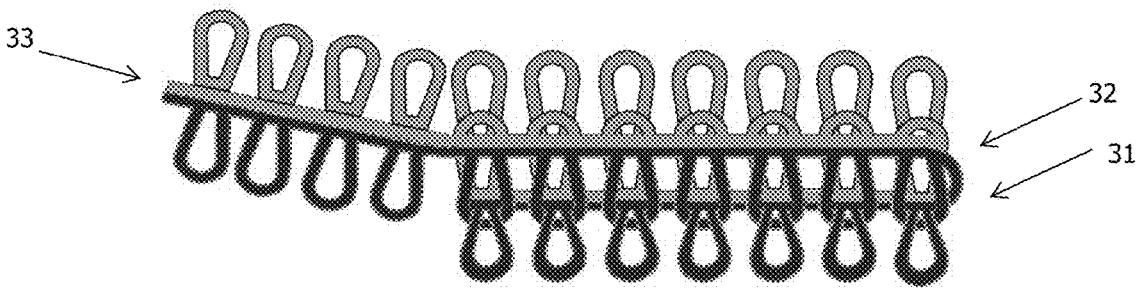
FIG. 6 demonstrates the view of loops after all loops of both the first and second loop sets of the secondary row are threaded through the loops of the primary row.

Preferably, above disclosed method step comprises threading each one of the loops of the second loop set (21) of the secondary row (32) through the interior space (43) of each one of the respective corresponding loops of the second loop set (21) of the primary row (31). FIG. 6 shows the illustration of the knitted thread (30) and the loops (40) after this method step is applied to the loops of the primary row (31) and secondary row (32). This method step of (iv) is repeated according to demand of the knitter/user.

As will be appreciated by the skilled person, the method step (iii) disclosed above further includes threading each one of the loops (40) of the first loop set (10) and/or the second loop set (20) of an arranged third row (33), through the interior spaces (43) of each one of the respective corresponding loops (40) of a row, which was obtained by threading the loops (40) of the secondary row (31) through the corresponding loops (40) of the primary row (31), The similar steps, which were applied to third row, are also performed for arranged fourth, fifth and forthcoming rows respectively by threading the loops (40) of the same with loops (40) of rows obtained in the previous threading step. Accordingly, the method step (iii) disclosed above further includes:

(a) threading each one of the loops (40) of the first loop set (10) and/or the second loop set (20) of an arranged tertiary row (33) through the interior spaces (43) of each one of the respective corresponding loops (40) of a threaded row, which was obtained by threading the loops (40) of the secondary row (31) through the corresponding loops (40) of the primary row (32); and (b) threading each one of the loops (40) of the first loop set (10) and/or the second loop set (20) of an arranged quaternary row (34) through the interior spaces (43) of each of the respective corresponding loops (40) of another threaded row, which was obtained by threading the loops (40) of the tertiary row (33) through the corresponding loops (40) of the threaded row (31);

(c) replying threading steps of a orb to a next arranged row of the plurality of rows and a previous threaded row obtained, till a final arranged row) of the plurality of rows is reached.

FIG. 7 and FIG. 8 illustrate respectively the second surface (102) and the first surface (101) of the knitted product (100) where all loops (40) of arranged five rows are knitted by threading to each other.

According to a preferred embodiment of the present invention, each one of the rows arranged in step (i) comprises the same number of loops (40). Accordingly, the knitted product (100) formed according to the disclosed method of the present invention will be in the shape of a rectangle. However, if the knitter wishes to obtain a knitted product (100) having a different shape than a rectangle, each one of the rows can be arranged as to include a different number of loops (40) for creating the desired shape.

According to a preferred embodiment of the present invention, a knitted product (100) having a first surface (101) and a second surface (102) in different colors and/or that provide different structural properties may be created by using the knitting yarn (1) and the knitting method according to the present invention. The loops (40) of the disclosed knitting yarn (1) of the present invention are optionally selected as to be made of component yarns having different physical and/or structural properties when compared, i.e.; component yarns of first loop set (10) are different than the component yarns of second loop set (20) of the knitting yarn (1). Furthermore, this difference between the component yarns of the first loop set (10) and the component yarns of second loop set (20), or individually each of the loops (40), may be due to the structural difference of the raw materials from which they have been produced, or due to the fact that the yarns are selected as to provide different physical properties, such as color. For example, all loops (40) of a loop set may be made of cotton, while the loops (40) of the other loop set are made of from different yarn types, such as wool, polyester, silk, linen, nylon, or combinations thereof. On the other hand, the loop sets or loops (40) may be selected of different colors, color combinations or different thicknesses. One or more of the loops (40) or loop sets may have a flexible/elastic structure, while the other may not be capable of stretching. Optionally, component yarns of the first and second loop sets may be different from each other, i.e. such as twisted, curly, boucle and/or chenille etc., and also can be dyed with different dyeing techniques. Each of the examples mentioned here can be expanded and applied individually to the knitting yarn (1) according to the invention, or can be applied in different combinations depending on the request or need.

The first surface (101) of the knitted product (100) obtained by knitting the knitting yarn (1) according to the method described herein will exhibit the properties of the first loop set (10) while the second surface (102) will exhibit the properties of the second loop set (20). Accordingly, due to the fact that the first loop set (10) and the second loop set (20), which are essentially symmetrical to each other around the symmetry axis (A), have different properties, the technical properties of the surfaces of the knitted product (100) provided in the present invention will also be different. While there are front and back sides of a knitted product (100) is formed when the known threads are knitted according to the known methods, both the first surface (101) and the second surface (102) of the knitted product (100) obtained by using the disclosed knitting method with the disclosed knitting yarn (1) of the present invention can also be used as the front face. In other words, the knitted product (100) of the present invention does not have a back face however; it comprises two faces which are both suitable to be used as a front face, i.e. the first surface (101) and the second surface (102). On the other hand, the feature is obtained without using any weft-warp since it is formed by hand-knitting and also the first and second surfaces (101, 102) are obtained as a contiguous structure. Thus, a knitted product (100) can be obtained which has a first surface (101) made of a material that is suitable for using in cold weather conditions, such as wool and a second surface (102) made of a material that is suitable for using in hot weather conditions, such as cotton. Similar examples can be expanded on the basis of the requirements for obtaining a knitted product (100) i.e.; with surfaces having different colors, with surfaces one of which is bright and the other one is dull.

Figure 13A:
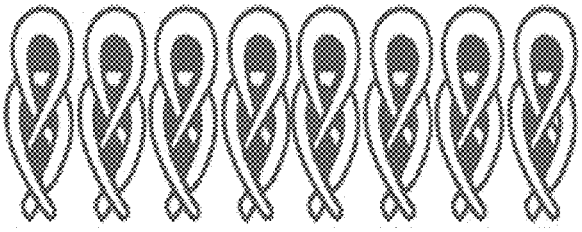
FIGS. 13*a* and 13*b* respectively demonstrate a detailed view and a general view of second surface of a knitted product formed by the method according to the present invention.
Figure 13B:
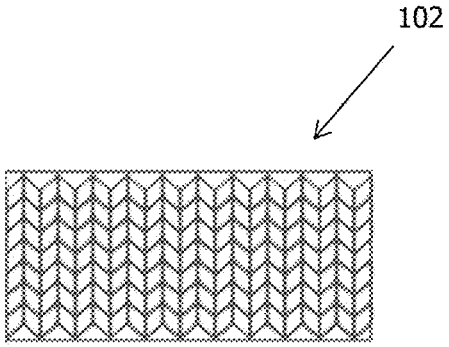
Figure 14A:
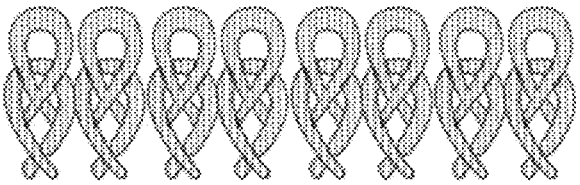
FIGS. 14*a* and 14*h* respectively demonstrate a detailed view and a general view of first surface of a knitted product formed by the method according to the present invention.
Figure 14B:
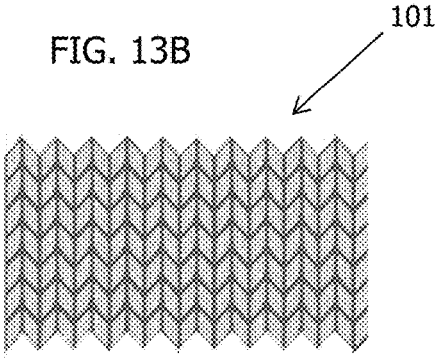
Figure 15A:
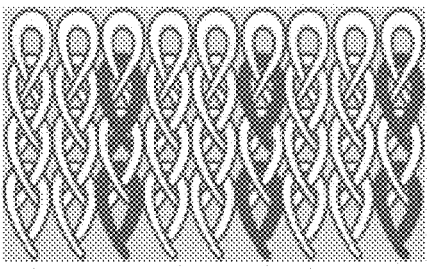
FIGS. 15*a* and 15*b* respectively demonstrate a detailed view and a general view of second surface of a knitted product having a pattern thereon, which has been knitted by the method according to the present invention.
Figure 15B:
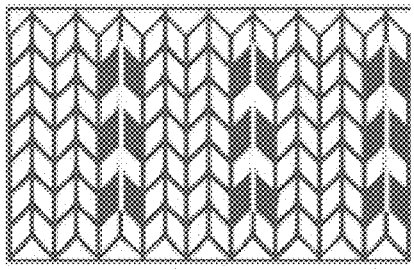
Figure 16A:
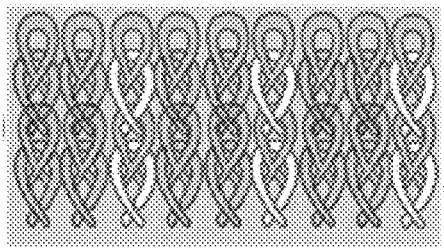
FIGS. 16*a* and 16*b* respectively demonstrate the detailed view and general view of first surface of a knitted product having a pattern thereon, which has been knitted by the method according to the present invention.
Figure 16B:
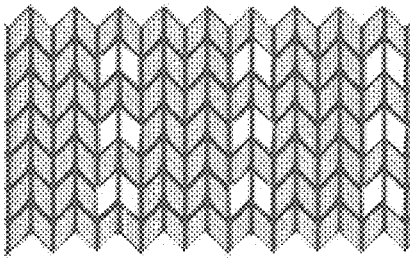

FIG. 2 is an example showing the knitting yarn (1) wherein loops of the first loop set (11) are black and the loops of the second loop set (21) are grey. When the disclosed knitting yarn (1) is knitted according to the method steps disclosed above as shown in FIG. 2-FIG. 6, the knitted product (100) is obtained having a first surface (101) in black color, as shown in FIG. 8 and a second surface (102) in grey color, as shown in FIG. 7. Furthermore, FIG. 13A and FIG. 13B respectively show the detailed view and general view of second surface (102) of a knitted product (100) which is obtained in white color, and FIG. 14A and FIG. 14B respectively show the detailed view and general view of first surface (101) of the same knitted product (100) which is obtained in grey color. In this example the loops of the first loop set (11) are selected as to be in grey color and the loops of the second loop set (21) are selected as to be in white color. Furthermore, as will be appreciated by a person skilled in the art, the thread (30) will stand between the first surface (101) and the second surface (102) of the knitted product (100) and thus it may be not visible on the knitted product (100) to a user/person, based on the component yarn(s) thickness of the loops (40).

According to an embodiment of the present invention, loops of the first loop set (11) and/or loops of the second loop set (21) have an elastic structure which causes the knitter to be facilitated during the knitting process and in particular when threading a loop (40) through the interior space (43) of another loop (40). Additionally, the knitted surface (100) obtained by using the above-described knitting yarn (1) and method also has an elastic structure.

On the other hand, any pattern may be created onto the surfaces (101 and 102) of the knitted product (100) by using the knitting yarn (1) according to the present invention where the first loop set (10) and the second loop set (20) of the knitting yarn (1) are preferably selected as to be in different colors for forming patterns in different colors. FIG. 1 shows the knitting yarn (1) according to the present invention wherein loops of the first loop set (11) are grey and the loops of the second loop set (21) are white. FIG. 15A, FIG. 15B, FIG. 164 and FIG. 16B, 16B illustrate the knitted product (100) which is knitted by using the disclosed knitting yarn (1) of FIG. 1. As shown in FIG. 15A, 15B, FIG. 16A and FIG. 16*b*, patterns in the shape of reverse "v" are provided both on the first and second surfaces (101, 102) of the knitted product (100) by following the method steps of; —arranging the knitting yarn (1) into a plurality of rows, i.e. primary row (31) and secondary row (32) each of which includes a first loop set (10) and a second loop set (20), which are selected as to be in different physical and/or structural properties; —threading first loop of a first loop set (11) of the arranged secondary row (32) through an interior space (43) of a first loop of a first loop set (11) of the arranged primary row (31); —applying similar threading step to first loop of a second loop set (21) of the arranged secondary row (32) through first loop of a second loop set (21) of the arranged primary row (31); —threading second loop of the first loop set (11) of the secondary row (32) through the interior space (43) of second loop of the first loop set (11) of the primary row (31) which is adjacent to said first loop of a first loop set (11) of the primary row (31); —applying similar threading step to second loop of the second loop set (21) of the secondary row (32) through second loop of the second loop set (21) of the primary row (31); —threading third loop of the first loop set (11) of the secondary row (32) through an interior space (43) of third loop of the second loop set (21) of the primary row (31); and —threading third loop of the second loop set (21) of the secondary row (32) through an interior space (43) of third loop of the first loop set (11) of the primary row (31); and furthermore these threading steps are repeated for the $4^{th}$ to $9^{th}$ loops (10) of the rows (31 and 32) for obtaining the pattern on FIG. 15A, FIG. 15B, FIG. 16A and FIG. 16B until all loops of the secondary row (32) are threaded. Then each one of the loops (40) of an arranged third row (33) is threaded through the corresponding loops (40), which were obtained by treading the loops (40) of the secondary row (32) through the corresponding loops (40) of the primary row (31). As will be appreciated by a skilled person in the art, different patterns may be obtained on the surfaces (101 and 102) of said knitted product (100) by just replacing/interchanging at least one loop of at least one first loop set (11) of a knitting yarn (1) with symmetric loop(s) of corresponding second loop set (21) of the same knitting yarn (1).

According to a preferred embodiment, the knitting method of the present invention further comprises the following steps for creating a pattern on the surfaces (101, 102) of the knitted product (100): threading at least one loop of a first loop set (11) of a determined row through an interior space (43) of each corresponding loop(s) of a second loop set (21) of a consecutive row, which is adjacent to the determined row; and threading at least one loop of a second loop set (21) of the determined row through an interior space (43) of each corresponding loop(s) of the first loop set (11) of the consecutive row, wherein the loops of the first loops set are symmetric to the loops of the second loop set around the axis. The symmetrical configuration of the loops (40) in a row allows creating of any pattern on the surfaces (101, 102) of a knitted product (100) according to the present invention.

After any of the method steps disclosed above are carried out and the knitted product (100) within the desired sizes is obtained, the knitting steps are terminated and optionally a binding step (v) is carried out on the knitted product (100) for binding off the loops (40) of a final row (39) together.

Figure 9:
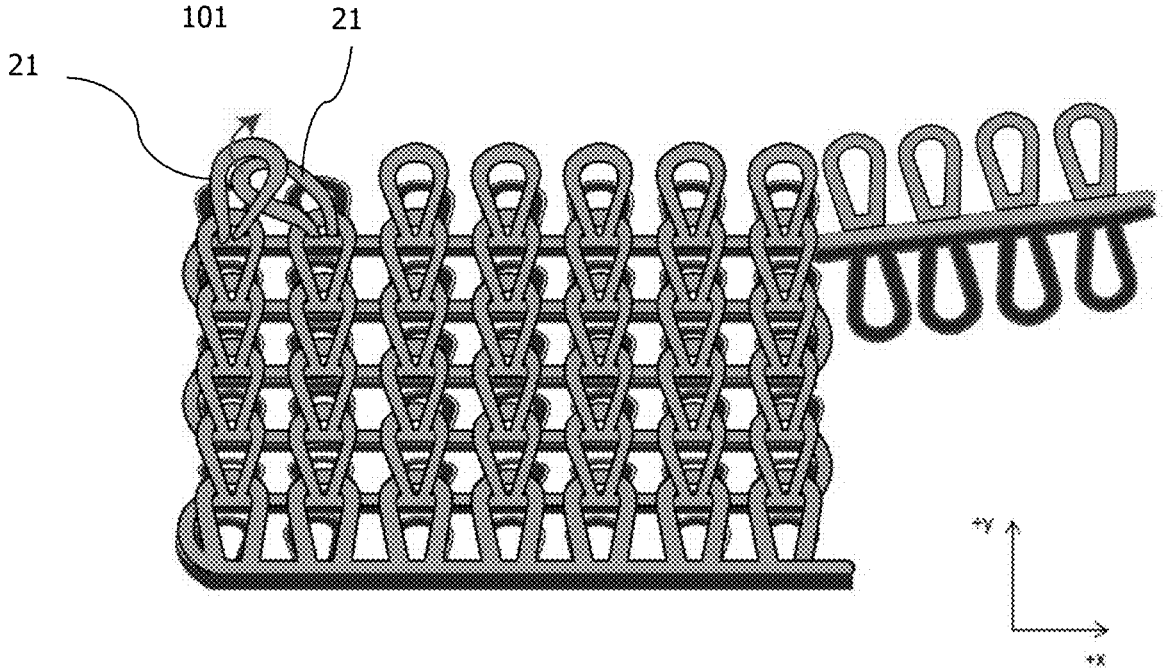
FIG. 9 demonstrates binding step (vi) of inserting a second loop of the second loop set of the final row through the interior space of an adjacent first loop of the second loop set of the final row.
Figure 10:
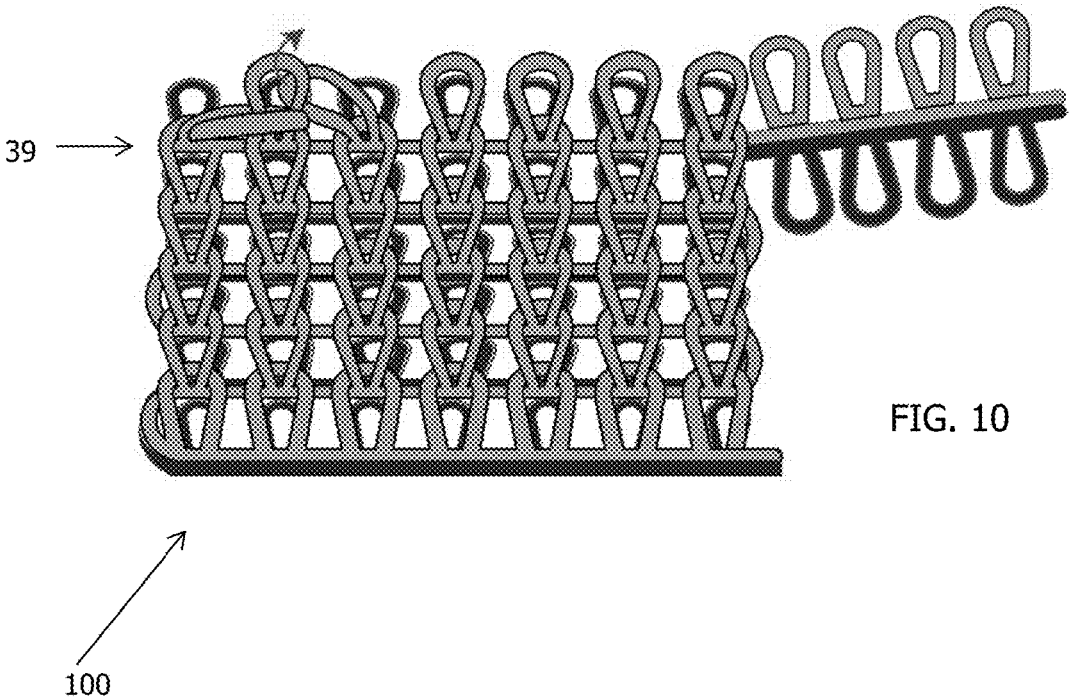
FIG. 10 demonstrates binding step (vii) of inserting a third loop of the second loop set of the final row through the interior space of the adjacent loop obtained in the step (vi)
Figure 11:
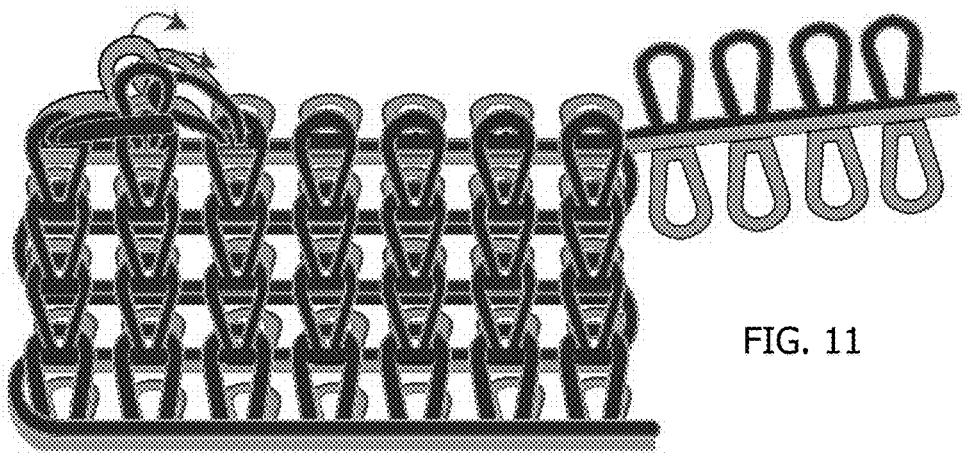
FIG. 11 demonstrates binding steps (vii) and (ix) of inserting third loops of the first and second loop sets of the final row through the interior spaces of the adjacent loops respectively obtained in the steps (vi) and (viii)
Figure 12:
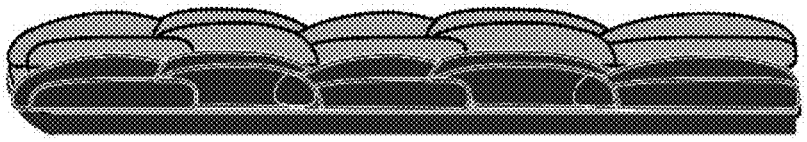
FIG. 12 demonstrates a top view of the knitted product after all loops of the final row are bound off.

The binding step (v) preferably comprises the intermediary steps of:

(vi) inserting a second loop of the first loop set (11) of the final row (39) through the interior space (43) of an adjacent first loop of the first loop set (11) of the final row (39); and (vii) inserting a third loop of the first loop set (11) of the final row (39) through the interior space (43) of the adjacent loop (40) obtained in above step (vi) of the first loop set (11) of the final row (39), as shown in FIG. 11;

(viii) inserting a second loop of the second loop set (21) of the final row (39) through the interior space (43) of an adjacent first loop of the second loop set (21) of the final row (39), as shown in FIG. 9; and (ix) inserting a third loop of the second loop set (21) of the final row (39) through the interior space (43) of the adjacent loop obtained in above step (viii) of second loop set (21) of the final row (39), as shown in FIG. 10 and FIG. 11;

(x) repeating steps (vii) and (ix) until all loops (40) of the final row (39) are bound off.

It should be appreciated that the order of processing of the described binding steps (vi) with (vii) and (x) with (xi) are interchangeable, since the same result will be obtained after both applications.

The knitting yarn (1) and the knitting method provided in the present invention are advantageous because it allows the production of knitted products (100) having different patterns, colors and/or properties.

The technical effects obtained by forming a knitted product (100) according to the method steps disclosed above and/or by using the knitting yarn (1) according to the present invention are disclosed above.

What is claimed is:

1. A knitting yarn for manually forming a knitted product without tools comprising:

a thread having a length dimension extending along an axis;

a plurality of loops affixed to or formed with the thread by extending outwardly of the thread; and each of the plurality of loops defining an interior space that receives another loop of the plurality of loops;

wherein, the plurality of loops include a first loop set extending outwardly along +y axis and a second loop set extending along −y axis, and the first loop set is essentially symmetrical to the second loop set around the axis.

2. The knitting yarn according to claim 1, wherein the thread or loops are made of one or more component yarns.

3. The knitting yarn according to claim 2, wherein physical or structural properties of the one or more component yarns of the first loop set and the second loop set are different.

4. The knitting yarn according to claim 1, wherein each of the plurality of loops includes a first end affixed to or formed with the thread and a second end affixed to or formed with the thread.

5. The knitting yarn according to claim 4, wherein in each loop, the first end and the second end are spaced apart from each other.

6. The knitting yarn according to claim 4, wherein interior space of each of the plurality of loops has a height greater than a width between the first end and second end of the loop.

7. The knitting yarn according to claim 4, wherein a second end of a primary loop is in spaced relation to a first end of a second loop adjacent to the primary loop within a same loop set.

8. A method of manually forming the knitted product by using the knitting yarn of claim 1, the method comprising:

(i) arranging the knitting yarn into a plurality of rows, wherein each row includes a predetermined number of loops;

(ii) threading one or more loops of a first loop set of an arranged secondary row through an interior space of each corresponding loop of a first loop set of an arranged primary row;

(iii) repeating the previous steps independently, until at least a piece of the knitted product is formed.

9. The method according to claim 8 further comprising the following step carried out after any one of the steps (ii) or (iii):

(iv) threading one or more loops of a second loop set of the arranged secondary row through an interior space of each corresponding loop of a second loop set of the arranged primary row.

10. The method according to claim 8, wherein the step (iii) further includes:

(a) threading each of the loops of the first loop set or the second loop set of an arranged tertiary row threading through the interior spaces of each of the respective corresponding loops of a threaded row which was obtained by threading the loops of the second row through the interior space of each of the corresponding loops of the primary row; and (b) threading each of the loops of the first loop set or the second loop set of an arranged quaternary row through the interior spaces of each of the respective corresponding loops of another threaded row, which was obtained by threading the loops of the tertiary row through the corresponding loops of the threaded row; and (c) repeating the threading steps of a orb to a next arranged row of the plurality of rows and a previous threaded row obtained until a final arranged row of the plurality of rows is reached.

11. The method according to claim 8, wherein the method further comprises threading at least one loop of a first loop set of a determined row through an interior space of each corresponding loop of a second loop set of a consecutive row, the consecutive row is adjacent to the determined row.

12. The method according to claim 11, wherein the method further comprises threading at least one loop of a second loop set of the determined row through an interior space of each corresponding loop of the first loop set of the consecutive row, wherein the loops of the first loops set are symmetric to the loops of the second loop set around the axis.

13. The method according to claim 8, wherein each of the rows arranged in step (i) comprises a same or a different number of loops.

14. The method according to claim 8, further comprising the following steps carried out after step (iii):

(v) binding off the loops of a final row together.

15. The method according to claim 14, wherein the binding step (v) further comprises the intermediary steps of:

(vi) inserting a second loop of the first loop set of the final row through the interior space of an adjacent first loop of the first loop set of the final row;

(vii) inserting a third loop of the first loop set of the final row through the interior space of the adjacent loop obtained in above step (vi) of the first loop set of the final row;

(viii) inserting a second loop of the second loop set of the final row through the interior space of an adjacent first loop of the second loop set of the final row;

(ix) inserting a third loop of the second loop set of the final row through the interior space of the adjacent loop obtained in above step (viii) of second loop set of the final row; and (x) repeating inserting steps (vii) and (ix) to further loops and obtained loops respectively until all loops of the final row are bound off.

16. The knitted product obtained by the method of claim 8.

17. The knitting yarn according to claim 2, wherein each of the plurality of loops includes a first end affixed to or formed with the thread and a second end affixed to or formed with the thread.

18. The knitting yarn according to claim 3, wherein each of the plurality of loops includes a first end affixed to or formed with the thread and a second end affixed to or formed with the thread.

19. The method according to claim 10, wherein the method further comprises, threading at least one loop of a first loop set of a determined row through an interior space of each corresponding loop of a second loop set of a consecutive row, which is adjacent to the determined row;

threading at least one loop of a second loop set of the determined row through an interior space of each corresponding loop of the first loop set of the consecutive row, wherein the loops of the first loops set are symmetric to the loops of the second loop set around the axis.

20. The method according to claim 10, further comprising the following steps carried out after step (c):

(xi) binding off the loops of the final row together.

* * * * *